US008427408B2

(12) United States Patent
Lee

(10) Patent No.: US 8,427,408 B2
(45) Date of Patent: Apr. 23, 2013

(54) METHOD OF PROVIDING DATA, LIQUID CRYSTAL DISPLAY DEVICE AND DRIVING METHOD THEREOF

(75) Inventor: Ju Young Lee, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1300 days.

(21) Appl. No.: 11/432,589

(22) Filed: May 11, 2006

(65) Prior Publication Data

US 2007/0030230 A1 Feb. 8, 2007

(30) Foreign Application Priority Data

Aug. 2, 2005 (KR) ..... 10-2005-0070582
Apr. 19, 2006 (KR) ..... 10-2006-0035296

(51) Int. Cl.
*G09G 3/36* (2006.01)

(52) U.S. Cl.
USPC ..... 345/87

(58) Field of Classification Search ..... 345/38, 345/87–104; 349/1, 19
See application file for complete search history.

(56) References Cited

U.S. PATENT DOCUMENTS 7,301,518 B2 * 11/2007 Hosaka ..... 345/94

FOREIGN PATENT DOCUMENTS

JP 2005-222589 8/2005
WO WO 2004/006008 1/2004

OTHER PUBLICATIONS

Notification of the First Office Action for corresponding Chinese Patent Application Serial No. 2006100872759, dated Dec. 28, 2007. Office Action issued in corresponding Japanese Patent Application No. 2006-156175; issued May 19, 2009.

* cited by examiner

*Primary Examiner* — Srilakshmi K Kumar
(74) *Attorney, Agent, or Firm* — Brinks Hofer Gilson & Lione

(57) ABSTRACT

A method of providing data, an LCD and a driving method are disclosed. An image data voltage is inverted. A charge share voltage between the inverted image data voltages is used as a black data. The image data voltage and the black data voltage are applied in sequence, wherein the charge share voltage between the inverted image data voltages is applied as the black data voltage. Thus, motion blurring may be suppressed and manufacturing cost may be reduced because it is unnecessary to generate the black data voltage separately. Also, the typical driving frequency is used even if the black data voltage is used, to reduce cost.

24 Claims, 9 Drawing Sheets

METHOD OF PROVIDING DATA, LIQUID CRYSTAL DISPLAY DEVICE AND DRIVING METHOD THEREOF

BACKGROUND

1. Technical Field

The present invention generally relates to a liquid crystal display device, and more particularly, to a method of providing data capable of preventing motion blurring phenomenon, a liquid crystal display device and a driving method thereof.

2. Description of the Related Art

Generally, a liquid crystal display device (LCD) is a device for displaying an image using a principle that each pixel of a liquid crystal panel acts as an optical switch to selectively transmit a light generated from a light source. In comparing a related art cathode ray tube (CRT) with an LCD, the related art CRT controls brightness by adjusting the intensity of electron beam, whereas the LCD controls the brightness of image by adjusting the intensity of light generated from the light source.

Meanwhile, as the image technology has been developed more and more, a technology displaying a motion picture as well as a still picture can be embodied in the LCD.

However, it is not easy to implement a motion picture well in the LCD. That is, since the response speed of a liquid crystal is slower than a frame rate in the motion picture, there occurs a motion blurring when applying a voltage newly in a next frame after a predetermined voltage. For example, an image signal or a data voltage, previously charged at the liquid crystal, is maintained for one frame. The data of the previous frame has an effect on the data of the next frame, which becomes a cause of the motion blurring phenomenon.

In particular, this motion blurring phenomenon strongly occurs in displaying a motion picture rather than in displaying a still picture.

FIG. 1A is a graph illustrating a light intensity versus time in a related art CRT, and FIG. 1B is a graph illustrating a light intensity versus time in a related art LCD.

Referring to FIG. 1A, the CRT is driven by an impulse type. In this case, since the data is displayed for only an extremely short time of each frame period, the data displayed for only the extremely short time does not have an effect on a next frame period.

In comparison, referring to FIG. 1B, the LCD is driven by a hold type. Accordingly, the data is continuously maintained for each frame period so that the data maintained during a previous frame period has an effect on a next frame period. The motion blurring phenomenon inevitably occurs in the related art LCD which is driven by the hold type.

To prevent the motion blurring phenomenon, there has been proposed a black data insertion (BDI) method in which image data is applied only during a predetermined period of one frame period and a black data is applied during the other period of one frame period. Herein, the black data means the data voltage corresponding to a black gray scale, e.g., 0 gray scale. Therefore, a human eye never detects any brightness, i.e., for example the gray scale more than 0, because each pixel displays the black gray scale due to the black data.

FIG. 2 is a schematic view illustrating the BDI method in a related art LCD.

Referring to FIG. 2, the image data voltage and the black data voltage are alternately applied to a liquid crystal panel during one frame period.

If there exist 488 gate lines, for example, a first through a fifth gate lines are sequentially activated first so that an image data voltage is applied to pixels of each activated gate line.

Thereafter, the first through the fifth gate lines are activated again so that the black data voltage is applied to the pixels of each activated gate line.

Subsequently, a sixth through a tenth gate lines are sequentially activated so that an image data voltage is applied to pixels of each activated gate line. Afterwards, the sixth through the tenth gate lines are activated again so that the black data voltage is applied to the pixels of each activated gate line.

Such an operation is performed repeatedly for one frame period in which 488 gate lines are activated.

Likewise, the same procedure is also performed during a next frame period.

In the related art LCD, a black data may be provided to a data driver after it may be generated in a timing controller. In this case, various circuits should be additionally employed for providing the black data generated by the timing controller to the liquid crystal panel via the data driver on an appropriate timing. As a result, the overall circuit becomes too complicated and too expensive.

In general, the LCD requires a predetermined frequency for activating each gate line one time within one frame period. However, as described above, since each gate line should be activated at least one time or more during the one frame period for applying the black data, the LCD using the BDI method requires higher driving frequency than the other LCDs, which complicates the design of a circuit for generating a high driving frequency. In addition, there may be a problem in that power consumption also increases, as the driving frequency increases. And the general black data insertion method has a dim line problem. There is a vertical blank period in the related LCD where no data is applied to the data lines and no gate scan pulse is applied to the gate lines. Because there is no data insertion during the vertical blank period, the data displayed on the LCD panel maintains a state of the beginning time of the vertical blank period. Therefore a boundary between the image data portions and the black data portions becomes more clear and the boundary is seen as a dim line problem. Because The boundary emerges at the same position at every frame and the liquid crystal has a sticky characteristic, the dim line becomes heavier.

SUMMARY

A liquid crystal display device includes: a liquid crystal panel with pixels. The pixels may be defined by gate lines and data lines. The LCD device includes a data driver for selectively applying an inverted image data voltage and a black data voltage. The black data voltage is generated from the inverted image data voltage. The LCD device includes a gate driver for supplying a scan signal for displaying the image data voltage and the black data voltage on the liquid crystal panel.

A method for providing data includes: generating an image data voltage corresponding to a video signal using a predetermined gamma value; inverting the image data voltage; and selectively applying the inverted image data voltage and a black data voltage generated from the inverted image data voltage in response to a predetermined control signal.

A method for driving a liquid crystal display device includes: selectively applying an image data voltage and a black data voltage; and supplying a scan signal for displaying the image data voltage and the black data voltage, wherein the black data voltage is a charge share voltage between inverted image data voltages It is to be understood that both the foregoing general description and the following detailed description of the invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Reference will now be made in detail to the LCD driving device, examples of which are illustrated in the accompanying drawings. Wherever possible, the same reference numbers will be used throughout the drawings to refer to the same or like parts.

Figure 1A:
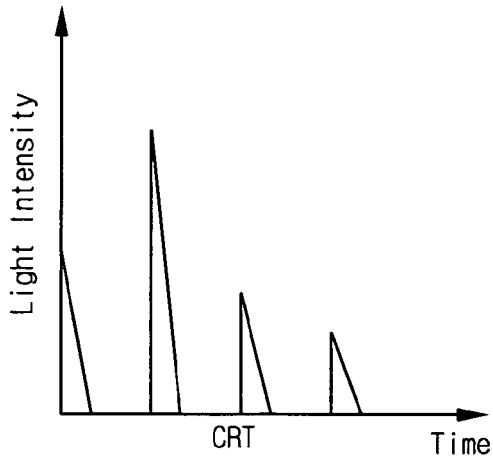
Fig. 1A (RELATED ART)
FIG. 1A is a graph illustrating a light intensity versus a time in a related art cathode ray tube (CRT).
Figure 1B:
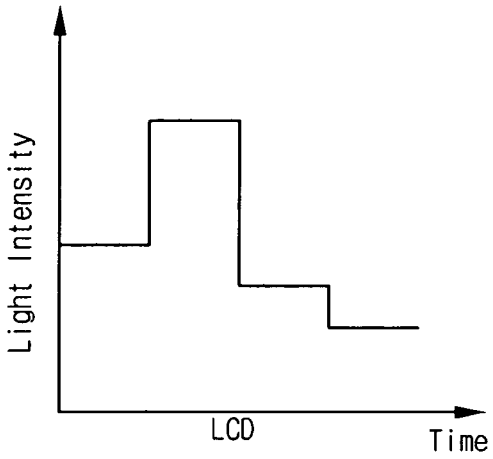
Fig. 1B (RELATED ART)
FIG. 1B is a graph illustrating a light intensity versus a time in a related art liquid crystal display device (LCD).
Figure 2:
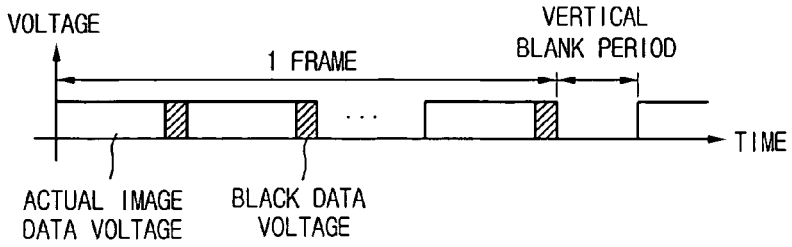
Fig. 2 (RELATED ART)
FIG. 2 is a schematic view illustrating a black data insertion method in a related art LCD.
Figure 3:
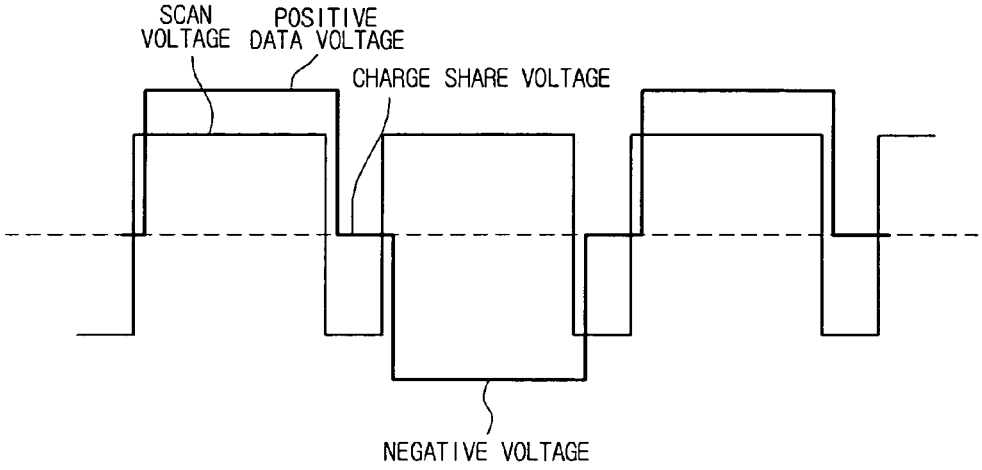
FIG. 3 is a waveform diagram of a voltage for driving a liquid crystal panel of an LCD.

FIG. 3 illustrates a waveform including a charge share voltage. The charge share voltage exists between a positive (+) data voltage and a negative (−) data voltage in an inversion driving scheme. The charge share voltage may be equal or similar to a common voltage. The charge share voltage may be generated from an exterior source or may be generated by an average value between adjacent data voltages.

In an inversion driving scheme, the positive data voltage transitions to the negative data voltage, and the negative data voltage transitions to the positive data voltage. The inversion driving scheme is implemented by repeatedly performing such a transition operation. However, since a large voltage difference exists in transition between the positive data voltage and the negative data voltage, the transition from the positive data voltage to the negative data voltage, and vice versa, may be difficult. Accordingly, because the desired data voltage may not be charged sufficiently in each pixel rapidly, it is difficult to obtain a desired brightness. A deteriorating image quality may result.

As illustrated in FIG. 3, the charge share voltage exists between the positive data voltage and the negative data voltage. Therefore, it is possible to rapidly transition between the positive and negative data voltages.

A section where the charge share voltage exists is referred to as a charge share section. The charge share section may be controlled by a source output enable (SOE) signal, which is one of the data control signals.

In the charge share section, the SOE signal includes a high level, and the charge share voltage is applied to the liquid crystal panel when the SOE signal is at the high level. However, the charge share voltage is not applied to each pixel of the liquid crystal panel in this case because no gate line is activated during the charge share section. On the contrary, when the SOE signal is at a low level, at least one of the positive and negative data voltages is applied to the liquid crystal panel. Because one of the gate lines in the liquid crystal panel is activated, one of the positive and negative data voltages may be applied to pixels on the activated gate line.

For example, the positive data voltage, the charge share voltage and the negative data voltage may be 5 V, 2 V and −3 V, respectively.

Because there is an 8 V voltage difference in transitioning between the positive data voltage and the negative data voltage, if the charge share voltage does not exist between the positive data voltage and the negative data voltage as in the related art, it takes more or less of time to transition between the positive and negative data voltages for overcoming the transition difference of 8 V.

However, if there is a charge share voltage between the positive and negative data voltages, the transition is executed from 5 V to 2 V, and, thereafter, from 2 V to −3 V. Therefore, the voltage difference in transition becomes 5 V so the voltage may rapidly transit from the positive data voltage to the negative data voltage.

Accordingly, the image quality may be enhanced because a desired brightness can be obtained as the desired data voltage is sufficiently rapidly charged at each pixel.

The positive and negative data voltages are provided to the pixels of the liquid crystal panel. The charge share voltage may not be applied to each pixel of the liquid crystal panel but may only be applied to each data line of the liquid crystal panel.

Figure 4:
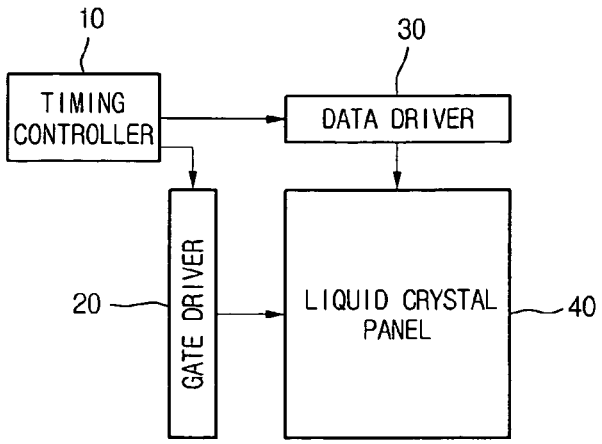
FIG. 4 is a block diagram of an LCD.
Figure 5:
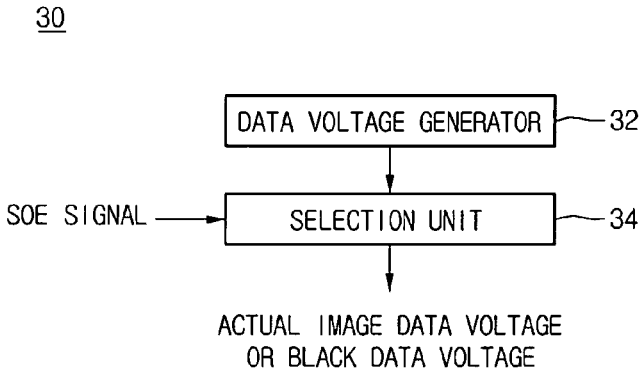
FIG. 5 is a block diagram illustrating a data driver of FIG. 4 in detail.
Figure 6:
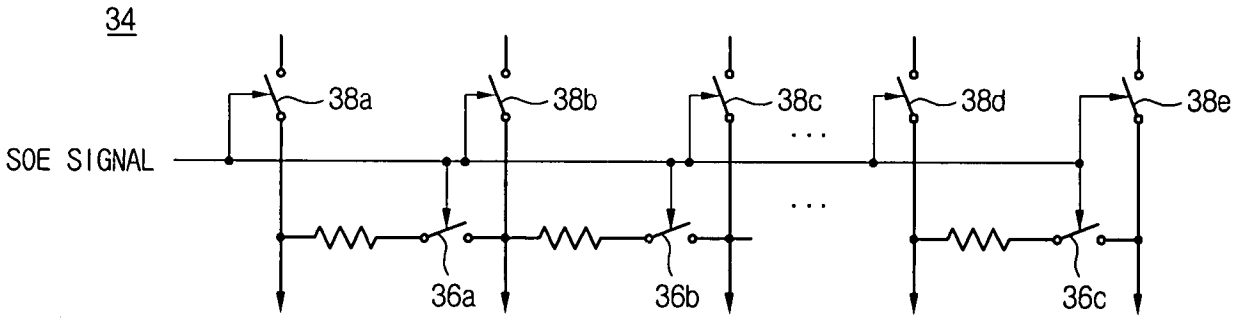
FIG. 6 is a circuit diagram illustrating a selection unit of FIG. 5 in detail.

FIG. 4 is a block diagram of an LCD. FIG. 5 is a block diagram illustrating a data driver of FIG. 4 in detail, and FIG. 6 is a circuit diagram illustrating a selection unit of FIG. 5 in detail.

Referring to FIG. 4, an LCD includes a timing controller 10, a gate driver 20, a data driver 30 and a liquid crystal panel 40.

In the liquid crystal panel 40, a plurality of gate liens are arranged in transverse direction and a plurality of data lines are arranged in longitudinal direction, wherein the plurality of gate lines are overlapped with the plurality of data lines thereby defining a plurality of pixels. A thin film transistor and a pixel electrode connected to the thin film transistor are formed in the pixel, wherein the thin film transistor is connected to the gate line and the data line. In addition, a common electrode is formed in the liquid crystal panel 40 for applying a common voltage. Therefore, a predetermined image may be displayed by means of the voltage difference between the common voltage applied to the common electrode and a data signal applied to the pixel electrode.

The timing controller 10 generates a first control signal such as GSC, GSP, GOE, or other signals, that drives the gate driver 20. The timing controller 10 generates a second control signal such as SSP, SSC, SOE, POL, or other signals, that drives the data driver 30. The timing controller 10 applies the first control signal to the gate driver 20, and applies the second control signal and a video signal provided from an exterior source to the data driver 30.

Referring to FIG. 5, the data driver 30 is configured with a data voltage generator 32 that generates an image data voltage to be supplied to the liquid crystal panel 40 using the video signal, and a selection unit 34 that selects at least one of the image data voltage and the black data voltage and outputs the selected voltage of the image data voltage and the black data voltage.

The black data voltage represents the charge share voltage. The LCD driver device utilizes the charge share voltage as the black data voltage, wherein the charge share voltage exists between the positive image data voltage and the negative image data voltage.

The data voltage generator 32 may include a shift register, first and second latches, and a digital-to-analog converter (DAC). The image data voltage generated from the data voltage generator 32 is inverted in response to the POL signal provided from the timing controller 10. The inversion may include a dot inversion, a line inversion, a frame inversion, or other inversion technique.

Red (R), green (G) and blue (B) data in the video signal serially provided from the timing controller 10 are latched at the first latch in sequence according to the output signal of the shift register. The latched red, green and blue data are latched at the second latch simultaneously after the latching is completed at the first latch.

The DAC generates the image data voltage related to the latched red, green and blue data of the second latch using a predetermined gamma value. At this time, each of the image data voltages may be inverted to be positive or negative in response to the POL signal applied from the timing controller 10.

The image data voltage which is inverted to be positive or negative is output from the data voltage generator 32.

Referring to FIG. 6, the selection unit 34 generates the black data voltage based on the image data voltages output from the voltage generator 32.

The selection unit 34 includes first switches 36*a*, 36*b* and 36*c* disposed between data lines, and second switches 38*a*, 38*b*, 38*c*, 38*d* and 38*e* disposed along data lines. The first and second switches 36*a* to 36*c* and 38*a* to 38*e* conversely operate with each other. That is, if the first switches 36*a*, 36*b* and 36*c* are closed, the second switches 36*a* to 36*c* and 38*a* to 38*e* may be opened. Likewise, if the first switches 36*a*, 36*b* and 36*c* are opened, the second switches 36*a* to 36*c* and 38*a* to 38*e* may be closed.

The first and second switches 36*a* to 36*c* and 38*a* to 38*e* may controlled by the SOE signal applied from the timing controller 10. If the SOE signal is at a high level, the first switches 36*a* to 36*c* are shorted and the second switches 38*a* to 38*e* are opened. On the contrary, if the SOE signal is at low level, the first switches are 36*a* to 36*c* is opened and the second switches 38*a* to 38*e* are shorted.

The selection unit 34 outputs at least one of the image data voltage and the black data voltage under the control of the SOE signal. For example, since the first switches 36*a* to 36*c* of the selection unit 34 are opened and the second switches 38*a* to 38*e* are shorted if the SOE signal is at a low level, the image data voltage is output to data lines. Because the first switches 36*a* to 36*c* are shorted and the second switches 38*a* to 38*e* are opened if the SOE signal is at a high level, the black data voltage is output. In this case, the black data voltage is the charge share voltage having an average value between adjacent image data voltages. The charge share voltage is approximately equal to the average value of the image data voltages If the SOE signal is at a low level, the first switches 36*a* to 36*c* are opened and the second switches 38*a* to 38*e* are shorted. Therefore, the positive and negative data voltages are output from the selection unit 34, respectively. In case that the SOE signal is at a high level, each first switches 36*a* to 36*c* are shorted and each second switches 38*a* to 38*e* are opened. The charge share voltage, which is related to the average value between adjacent image data voltages, may be output.

The charge share voltage may be used as the black data voltage.

Figure 7:
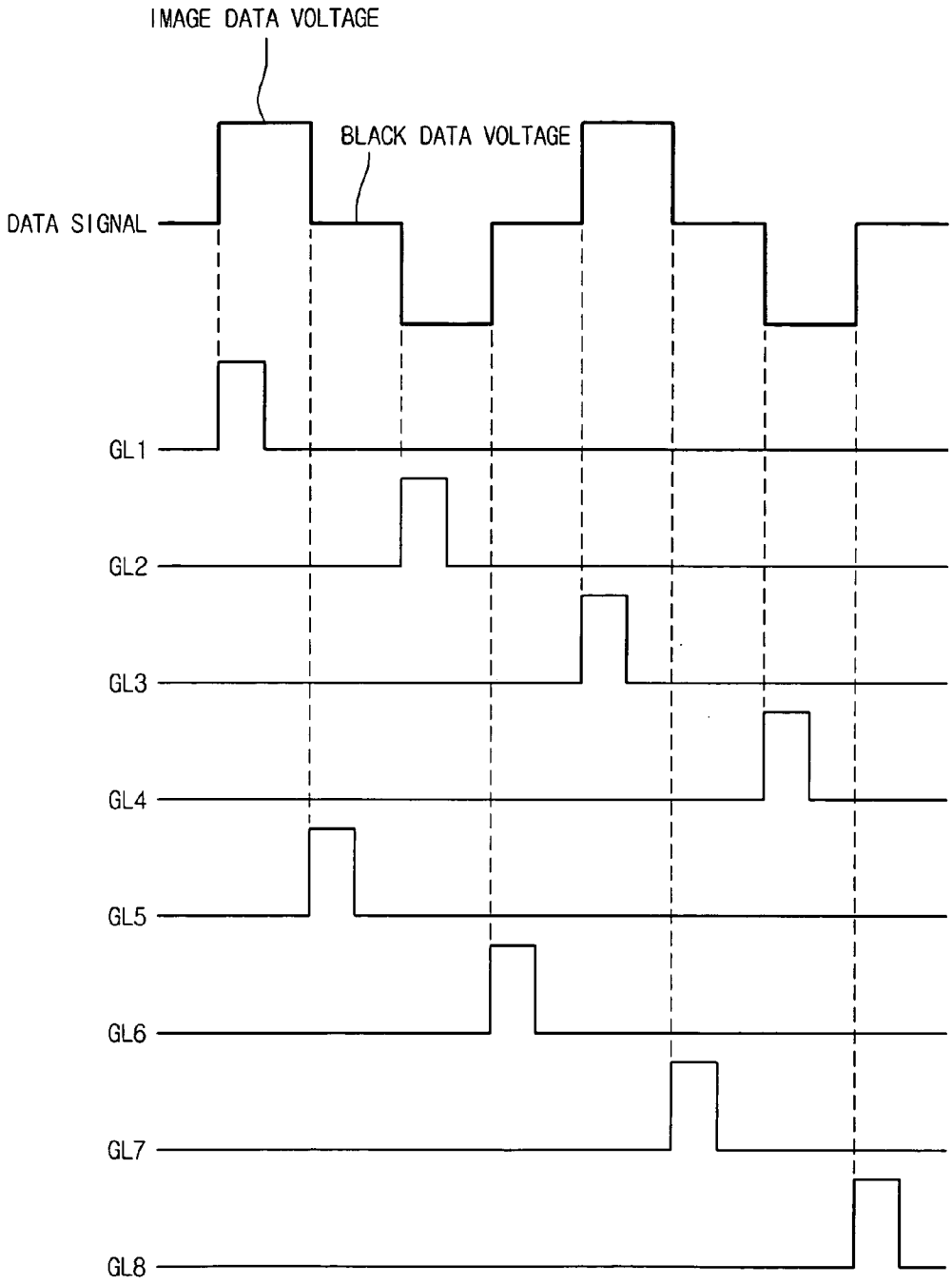
FIG. 7 is a waveform diagram of a data voltage in the LCD.
Figure 8:
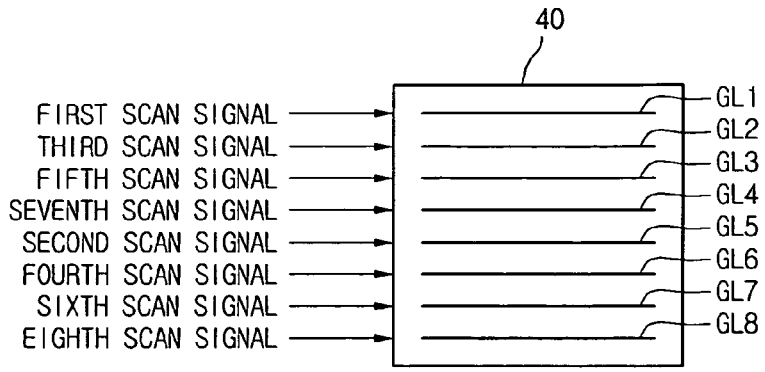
FIG. 8 is a schematic view illustrating a state that scan signals are applied to gate lines of the liquid crystal panel of FIG. 4.

As illustrated in FIG. 7, the gate driver 20 generates and outputs scan signals in sequence, and the data driver 30 sequentially outputs the image data voltage and the black data voltage. As illustrated in FIG. 8, for instance, the liquid crystal panel 40 may be provided with a first to an eighth gate lines GL1 to GL8. In this case, the first scan signal may be supplied to the first gate line GL1, whereas the second scan signal may skip the second to fourth gate lines GL2 to GL4 and may be supplied to the fifth gate line GL5. Subsequently, the third scan signal may be supplied to the second gate line GL2 and the fourth scan signal may be supplied to the sixth gate line. Likewise, the fifth and sixth scan signals may be supplied to the third and seventh gate lines GL3 and GL7, respectively, and the seventh and eighth scan signals may be supplied to the fourth and eighth gate lines GL4 and GL8, respectively.

In this manner, whenever each scan signal is supplied to the liquid crystal panel 40, the data driver 30 applies one of the image data voltage and the black data voltage to the gate line.

For example, a first image data voltage is applied to a pixel on the first gate line GL1 to which the first scan signal is supplied, and a first black data voltage is applied to a pixel on the fifth gate line GL5 to which the second scan signal is supplied. Likewise, a second image data voltage is applied to a pixel on the second gate line GL2 to which the third scan signal is supplied, and a second black data voltage is applied to a pixel on the sixth gate line GL6 to which the fourth scan signal is supplied. A third image data voltage is applied to a pixel on the third gate line GL3 to which the fifth scan signal is supplied, and a third black data voltage is applied to a pixel on the seventh gate line GL7 to which the sixth scan signal is supplied. A fourth image data voltage is applied to a pixel on the fourth gate line GL4 to which the seventh scan signal is supplied, and a fourth black data voltage is applied to a pixel on the eighth gate line GL8 to which the eighth scan signal is supplied.

Thus, one scan signal has been supplied to each of the first to eighth gate lines GL1 to GL8. However, one frame image is not displayed yet because no image data voltage is applied to the pixel on the fifth to the eighth gate lines GL5 to GL8. Therefore, in order to completely display the one frame image, scan signals should be sequentially supplied to the fifth, the first, the sixth, the second, the seventh, the third, the eighth, and the fourth gate lines GL5, GL1, GL6, GL2, GL7, GL3, GL8 and GL 4. Accordingly, a fifth image data voltage, a fifth black data voltage, a sixth image data voltage, a sixth black data voltage, a seventh image data voltage, a seventh black data voltage, an eighth image data voltage and an eighth black data voltage are supplied to pixels of the fifth, the first, the sixth, the second, the seventh, the third, the eighth, and the fourth gate lines GL5, GL1, GL6, GL2, GL7, GL3, GL8 and GL 4, respectively.

Herein, each of the first, the third, the fifth and the seventh image data voltage is a positive data voltage which is higher than the black data voltage, whereas each of the second, the fourth, the sixth and the eighth image data voltage is a negative voltage which is lower than the black data voltage. Therefore, the data voltage may be inverted in every gate line unit. Undoubtedly, the data voltage may be inverted in every frame unit.

After all, the scan signals are twice supplied to each of the gate lines, wherein one scan signal is supplied for applying the image data voltage to the pixel on each gate line and the other scan signal is supplied for applying the black data voltage to the pixel on each gate line.

Although it is illustrated that the eight gate lines are provided in the liquid crystal panel 40 for the sake of illustrative convenience, hundreds or thousands of gate lines are included in the liquid crystal panel 30 actually. Therefore, a space corresponding to hundreds of gate lines may exist between the gate line of the pixel to which the image data voltage is supplied and the gate line of the pixel to which the black data voltage is supplied.

Figure 9:
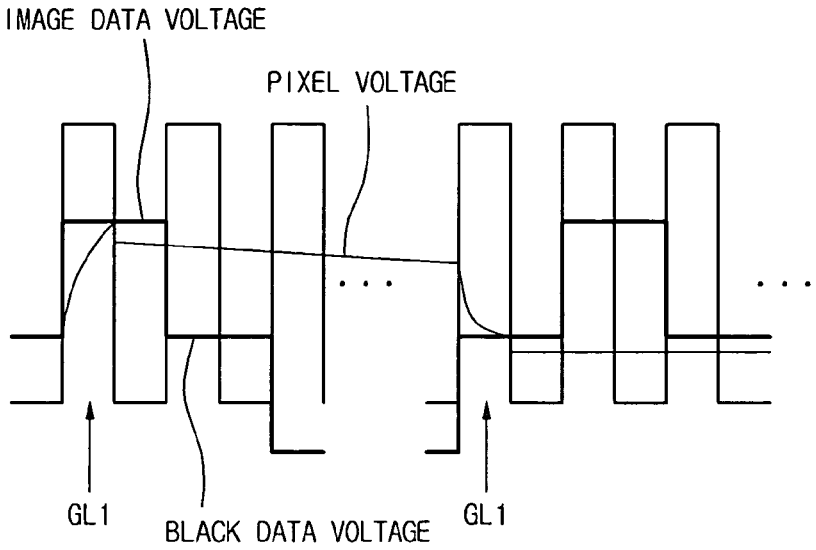
FIG. 9 is a waveform diagram of a voltage charged at a specific pixel.

FIG. 9 is a data voltage diagram for one pixel according to FIG. 7, 8. the first scan signal is supplied to a specific gate line, e.g., the first gate line GL1, whereby the first image data voltage is charged in the pixel on the first gate line GL1. After the lapse of a predetermined time, a tenth scan signal is supplied to the first gate line GL1. As a result, the fifth black data voltage is charged in the pixel on the first gate line.

The gate lines are activated at least once during one frame period so that the image data voltage and the black data voltage are displayed on the gate lines.

As described above, the black data voltage is applied to the gate lines in a predetermined time later after the image data voltage is applied to the gate lines. In some systems, the predetermined time should be less than one frame period. That is, the predetermined time should be shorter than one frame period to display the image data voltage and the black data voltage on the gate lines during the one frame period.

The image data voltage and the black data voltage are alternately displayed on the liquid crystal panel 40. The data voltage is repeatedly applied to the liquid crystal panel 40 in order of the positive image data voltage, the black data voltage, the negative image data voltage and the black data voltage.

Figure 10:
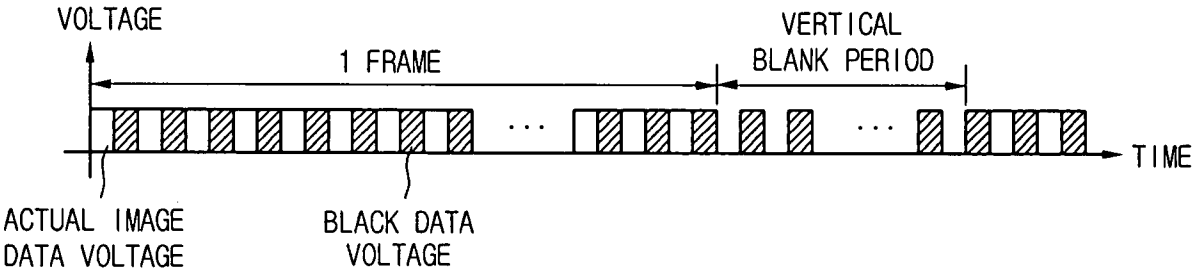
FIG. 10 is a schematic view illustrating a state that the data voltage is applied in frame units in the LCD.

And as illustrated in FIG. 10, the black data is also applied to the data lines during a vertical blank period and the gate lines are activated to display the black data after the gate line which has displayed the last black data.

In FIG. 10, the black data voltage is still applied from the data driver 30 to the liquid crystal panel 40 during a vertical blank period. Though the image data voltage is not applied to the liquid crystal panel 40 during the vertical blank period, the black data voltage is still applied to the liquid crystal panel 40 at a fixed interval. That is, the black data voltage is regularly applied to the liquid crystal panel 40 during the vertical blank period.

In order to supply the black data voltage to the pixel of each gate line of the liquid crystal panel during the vertical blank period, scan signals may be applied to each gate line. For instance, if the black data voltage is supplied to $10^{th}$ h to $30^{th}$ gate lines before the vertical blank period, the gate scan signals are supplied to the gate lines from the $31^{th}$ gate line sequentially during the vertical blank period. Accordingly, since the black data is continuously displayed during the vertical blank period and the boundary between the black data and the image data moves continuously, it is possible to prevent the dim line problem.

Because the black data voltage is generated from the charge share voltage not from the image data of the source D-IC, it is possible to apply the voltage during the vertical black period.

Meanwhile, because the image data prior to the black data voltage is charged at the pixel of the corresponding gate line in advance, it is possible to charge the pixel of the corresponding gate line to the black data voltage more rapidly using precharge effect.

The scan signal may be supplied before the black data voltage is supplied. To this end, the scan signal may be shifted or the width may be expanded by a predetermined gate control signal like GOE. Likewise, the image data voltage may be shifted or the width may be expanded by a predetermined data control signal like SOE.

Figure 11:
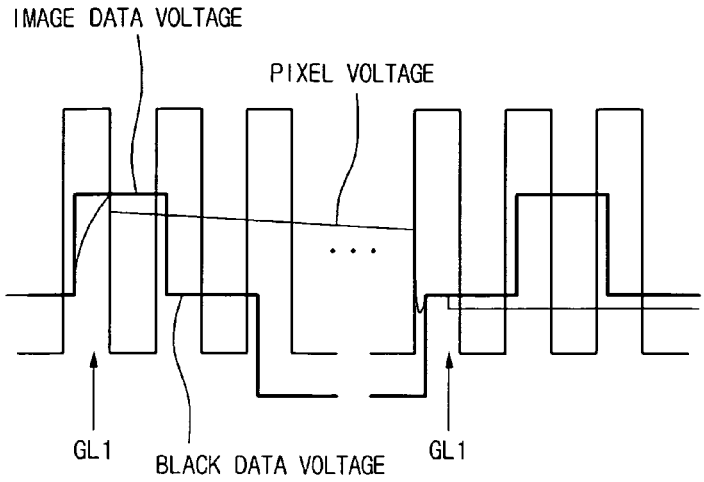
FIG. 11 is a voltage waveform diagram illustrating a pre-charge effect when a scan signal is supplied prior to the black data in the LCD.

Referring to FIG. 11, if the scan signal is applied prior to supplying the black data voltage, the image data voltage previously charged in the pixel is more rapidly discharged to the black data voltage by the precharge effect.

For example, the first scan signal is applied to the first gate line GL1 so that the positive image data voltage is charged in the pixel on the first gate line GL1.

At a predetermined time later, the first scan signal is applied to the first gate line GL1 again prior to applying the black data voltage. A thin film transistor (TFT) on the first gate line GL1 is turned on, when the data driver 30 is outputting the negative image data voltage to the data lines. The positive image data voltage, which is previously charged in the pixel on the first gate line GL1, is rapidly discharged by the negative image data voltage, and then the black data voltage is rapidly charged in the pixel on the first gate line GL1 because the black data voltage is output soon from the data driver 30.

By applying the scan signal prior to applying the black data voltage, the LCD driver device may rapidly transition the image data voltage to the black data voltage.

Figure 12:
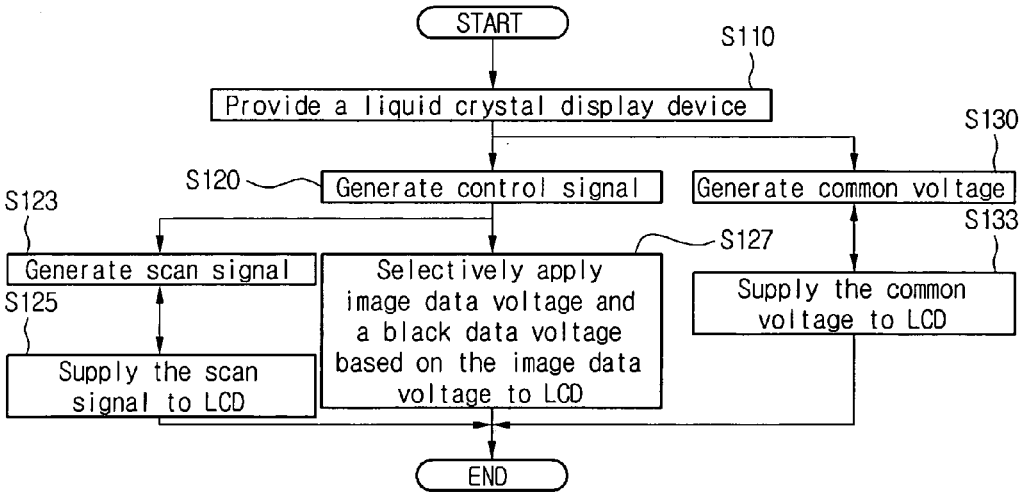
FIG. 12 is a flowchart illustrating a method of displaying data on the LCD of FIG. 4.

FIG. 12 is a flowchart illustrating a method of displaying data on the LCD of FIG. 4. The LCD is provided (S110). A predetermined control signal is generated at the timing controller (S120). The predetermined control signal includes a first control signal for controlling the scan signal, and a second control signal for controlling the data.

A common voltage is generated from a predetermined common voltage generator (S130). The common voltage is supplied to the common electrode of the LCD (S133). The common voltage is a reference voltage for driving the liquid crystal. The liquid crystal is driven by the voltage difference between the common voltage and a predetermined voltage which is higher or lower than the common voltage so that a predetermined image is displayed.

The scan signal is generated at the gate driver using the first control signal (S123). The scan signal is supplied to the LCD. In detail, the scan signals are sequentially supplied at the interval of a predetermined gate line. For example, if the first to eighth gate lines are provided in the LCD, the scan signals may be supplied to the gate lines in order of the first, the fifth, the second, the sixth, the third, the seventh, the fourth and the eighth gate line.

The predetermined data voltage is generated at the data driver. Herein, the data voltage means an analog data voltage in which a gamma voltage is considered. In the present invention, the analog data voltage is designated as the image data voltage. If the image data voltage is higher than the common voltage, it becomes a positive data voltage. On the contrary, if the image data voltage is lower than the common voltage, it is becomes a negative data voltage.

In the data driver, the image data voltage and the black data voltage are selectively applied to the LCD (S127). The black data voltage means an average value of the image data voltage, which may be a charge share voltage. The charge share voltage is approximate to the common voltage.

The LCD driver device utilizes the charge share voltage existing between the image data voltages as the black data voltage so that the image quality can be improved.

As described above, because the charge share voltage existing between the image data voltages is used as the black data voltage, the motion blurring phenomenon may be prevented. The circuit may be simplified and the fabrication cost reduced because it is unnecessary to generate the black data voltage separately.

In addition, because the charge share voltage existing between the respective image data voltages is used as the black data voltage as it is during the one frame period, the one frame period is not changed so that the driving frequency may be still used, which is helpful in reducing the fabrication cost as well.

It will be apparent to those skilled in the art that various modifications and variations can be made in the LCD driving device. Thus, it is intended that the invention covers the modifications and variations provided they come within the scope of the appended claims and their equivalents.

What is claimed is:

1. A liquid crystal display device comprising:

a liquid crystal panel comprising a plurality of gate lines and a plurality of data lines crossing each other;

a data driver that selectively applies image data and charge share voltage data;

a gate driver that supplies a first scan signal to display the image data and a second scan signal to display the charge share voltage data on the liquid crystal panel; and a timing controller for generating a first control signal including a gate shift control signal, a gate start pulse and a gate output enable signal and a second control signal including a source shift control signal, a source start pulse and a source output enable signal, wherein the data driver comprises a data voltage generator operable to generate the image data and a selection unit operable to select one of the image data or the charge share voltage data, wherein the charge share voltage data is generated by shorting the adjacent data lines and has an average voltage value based on the image data, wherein the one of the image data or the charge share voltage data is selectable by the source output enable (SOE) signal that controls an output of the data driver, wherein the selection unit comprises first switches disposed between the plurality of data lines and second switches different from the first switches disposed along the plurality of data lines, each switch of the first switches respectively coupled with two adjacent data lines of the plurality of data lines and each switch of the second switches respectively coupled in series with each data line of the plurality of data lines, and the first and second switches conversely operate with each other and are controlled by the source output enable (SOE) signal, wherein the first scan signal and the second scan signal are sequentially supplied respectively to one gate line among the plurality of gate lines and to another gate line among the plurality of gate lines other than the one gate line.

2. The liquid crystal display device of claim 1, wherein the charge share voltage data is a black data and exists between a positive image data and a negative image data.

3. The liquid crystal display device of claim 1, wherein the image data is selected if the source output enable signal comprises a low level.

4. The liquid crystal display device of claim 1, wherein the charge share voltage data is selected if the source output enable signal comprises a high level.

5. The liquid crystal display device of claim 1, wherein the image data and the charge share voltage data are applied to the liquid crystal panel in a sequence.

6. The liquid crystal display device of claim 1, wherein the gate lines are activated at least once during one frame period, and wherein the image data and the charge share voltage data are displayed on the activated gate lines.

7. The liquid crystal display device of claim 1, wherein the charge share voltage data is displayable on one of the gate lines at a time after the image data is displayed on the same one of the gate lines.

8. The liquid crystal display device of claim 7, wherein the time is less than at least one frame period.

9. The liquid crystal display device of claim 1, wherein the data is displayed on the liquid crystal panel during a frame period, wherein the frame period comprises a vertical blank period.

10. The liquid crystal device of claim 1, wherein the charge share voltage data is displayed on the liquid crystal panel during a frame period, except during a vertical blank period.

11. The liquid crystal display device of claim 1, wherein the scan signal is suppliable prior to applying the charge share voltage data.

12. A liquid crystal device according to claim 1, wherein the image data is inverted at every frame.

13. A liquid crystal device according to claim 1, further comprising a common voltage, wherein an average voltage of all data lines is substantially equal to the common voltage.

14. A liquid crystal device of claim 1, wherein the first switches and the second switches are operable alternately.

15. A liquid crystal device of claim 14, wherein the data driver is operable to generate the image data when the first switches are closed and the second switches are open, and wherein the data driver is operable to generate the charge share voltage data when the first switches are open and the second switches are closed.

16. A liquid crystal device of claim 1, wherein a gate control signal is operable to at least shift the scan signal or expand the scan signal.

17. A liquid crystal device of claim 1, wherein a data control signal is operable to at least shift the image data or expand the image data.

18. A method for providing data in a liquid crystal display device including at least a liquid crystal panel and a selection unit, the liquid crystal panel including a plurality of gate lines and a plurality of data lines crossing each other, the selection unit including first switches disposed between the plurality of data lines and second switches different from the first switches disposed along the plurality of data lines, the first and second switches conversely operating with each other, comprising:

generating image data corresponding to a video signal;

generating a first control signal including a gate shift control signal, a gate start pulse and a gate output enable signal and a second control signal including a source shift control signal, a source start pulse and a source output enable (SOE) signal;

generating a first scan signal and a second scan signal by using the first control signal;

sequentially supplying a first scan signal to one gate line among a plurality of gate lines for displaying the image data and a second scan signal to another gate line other than the one gate line for displaying the charge share voltage data;

opening the first switches and closing the second switches in response to a low level of the source output enable signal to select the image data;

closing the first switches and opening the second switches in response to a high level of the source output enable signal to select a charge share voltage data, the charge share voltage data generated by shorting the adjacent data lines and having an average value based on the image data; and supplying a common voltage to a liquid crystal display panel, wherein an average voltage of all data lines is substantially equal to the common voltage, wherein generating the image data comprises inverting the image data at every frame.

19. The method of claim 18, wherein the charge share voltage data is applied during a frame period, wherein the frame period comprises a vertical blank period.

20. The method of claim 18, wherein the charge share voltage data is further applied during a frame period, except during a vertical blank period.

21. A method for driving a liquid crystal display device including at least a liquid crystal panel and a selection unit, the liquid crystal panel including a plurality of gate lines and a plurality of data lines crossing each other, the selection unit including first switches disposed between the plurality of data lines and second switches different from the first switches disposed along the plurality of data lines, the first and second switches conversely operating with each other, comprising:

supplying a common voltage to a liquid crystal display panel, wherein an average voltage of image data is substantially equal to the common voltage;

generating a first control signal including a gate shift control signal, a gate start pulse and a gate output enable signal and a second control signal including a source shift control signal, a source start pulse and a source output enable signal;

generating a first scan signal and a second scan signal by using the first control signal; and sequentially supplying a first scan signal to one gate line among a plurality of gate lines for displaying the image data and a second scan signal to another gate line other than the one gate line for displaying the charge share voltage data, opening the first switches and closing the second switches in response to a low level of the source output enable signal to select the image data;

closing the first switches and opening the second switches in response to a high level of the source output enable signal to select a charge share voltage data, the charge share voltage data generated by shorting the adjacent data lines and having an average value based on the image data, wherein the charge share voltage data comprises a black data and exists between a positive image data and a negative image data.

22. The method of claim 21, wherein the charge share voltage data is applied during a frame period, wherein the frame period comprises a vertical blank period.

23. The method of claim 21, wherein the charge share voltage data is further applied during a frame period, except during a vertical blank period.

24. The method of claim 21, wherein supplying the scan signal comprises supplying the scan signal prior to applying the charge share voltage data.

* * * * *